US008845236B1

(12) United States Patent
Dosdourian et al.

(10) Patent No.: US 8,845,236 B1
(45) Date of Patent: Sep. 30, 2014

(54) GROUND ANCHOR

(71) Applicant: Fixdirt, LLC, Palm Beach Gardens, FL (US)

(72) Inventors: Samuel S. Dosdourian, Palm Beach Gardens, FL (US); Patricia A. Dosdourian, Palm Beach Gardens, FL (US)

(73) Assignee: FixDirt, LLC, Palm Beach Gardens, FL (US)

( * ) Notice: Subject to any disclaimer, the term of this patent is extended or adjusted under 35 U.S.C. 154(b) by 0 days.

(21) Appl. No.: 14/181,165

(22) Filed: Feb. 14, 2014

Related U.S. Application Data

(60) Provisional application No. 61/765,472, filed on Feb. 15, 2013.

(51) Int. Cl.
*E21D 20/00* (2006.01)

(52) U.S. Cl.
CPC ..... *E21D 20/00* (2013.01)
USPC ..... 405/259.1; 405/231; 405/252.1; 405/253; 52/157; 175/19; 175/323; 175/394

(58) Field of Classification Search
CPC ..... E21B 10/44; E21B 17/22; E21B 10/43; E21B 7/265; E02D 5/801; E02D 7/22; E02D 2200/1671; E02D 5/80; A01C 5/02; E21C 27/22; E21D 20/00
USPC ..... 405/231, 241, 252.1, 253, 254, 259.1; 175/19–23, 323, 394; 52/157
See application file for complete search history.

(56) References Cited

U.S. PATENT DOCUMENTS

| | | | | |
|---|---|---|---|---|
| 1,512,841 | A * | 10/1924 | Gamble | 175/413 |
| 4,022,286 | A * | 5/1977 | Gill | 175/313 |
| 4,061,197 | A * | 12/1977 | Skidmore, Jr. | 175/101 |
| 5,113,626 | A | 5/1992 | Seider et al. | |
| 5,120,163 | A | 6/1992 | Holdeman et al. | |
| 5,213,448 | A | 5/1993 | Seider et al. | |
| 5,219,246 | A | 6/1993 | Coutts et al. | |
| 5,408,788 | A | 4/1995 | Hamilton et al. | |
| 5,919,005 | A | 7/1999 | Rupiper | |
| 5,934,836 | A | 8/1999 | Rupiper et al. | |
| 6,033,152 | A * | 3/2000 | Blum | 405/241 |
| 6,402,432 | B1 | 6/2002 | England et al. | |
| 6,615,554 | B2 * | 9/2003 | Rupiper | 52/157 |
| 6,817,810 | B2 | 11/2004 | Jones | |
| 6,871,455 | B1 | 3/2005 | Cockman et al. | |
| 7,112,012 | B2 | 9/2006 | Whitsett | |
| 7,114,886 | B1 | 10/2006 | Slemons | |
| 7,314,335 | B2 | 1/2008 | Whitsett | |

(Continued)

*Primary Examiner* — John Kreck
*Assistant Examiner* — Carib Oquendo
(74) *Attorney, Agent, or Firm* — McHale & Slavin, P.A.

(57) ABSTRACT

A cutting device for use with installation of helical ground anchors designed to cut through rock. The invention has carbide steel cutting tips attached to the distal end of a shaft extending below the end in order to make a first cut through rock along the axis of rotation of the shaft. Helically shaped plates are attached to the shaft at a distance above the shaft set of cutting tips. Attached along the outer edge of the helix are additional carbide steel cutting tips that extend below the bottom surface of the helix and cut along the axis of rotation of the shaft. The present invention allows for the installation of helical ground anchor supports at proper depths without deviation, in situations where the path is obstructed by rock or other hard materials.

17 Claims, 3 Drawing Sheets

(56) References Cited

U.S. PATENT DOCUMENTS

| | | | | |
|---|---|---|---|---|
| 7,357,200 | B2 * | 4/2008 | Harleman | 175/323 |
| 7,686,103 | B2 | 3/2010 | Pile | |
| 7,736,095 | B2 | 6/2010 | Fujita | |
| 7,854,451 | B2 | 12/2010 | Davis, II | |
| 8,033,757 | B2 | 10/2011 | Stroyer | |
| 8,079,781 | B2 | 12/2011 | Ronnkvist | |
| 8,096,732 | B2 | 1/2012 | Brown | |
| 8,235,147 | B1 | 8/2012 | Seegmiller | |
| 8,302,706 | B1 | 11/2012 | Seegmiller | |
| 8,347,987 | B1 | 1/2013 | Seegmiller | |
| 8,506,207 | B2 * | 8/2013 | Lutenegger et al. | 405/253 |
| 2003/0044241 | A1 * | 3/2003 | Mure et al. | 405/231 |
| 2004/0000431 | A1 * | 1/2004 | Van Denham | 175/57 |
| 2004/0118615 | A1 * | 6/2004 | Beach | 175/394 |
| 2013/0008721 | A1 | 1/2013 | Seegmiller | |

* cited by examiner

GROUND ANCHOR

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/765,472, entitled "GROUND ANCHOR", filed Feb. 15, 2013. The contents of which the above referenced application is incorporated herein by reference.

FIELD OF THE INVENTION

The present invention relates generally to load bearing ground anchors and, more particularly, to an improved ground anchor having cutting bits positioned to cut through solid materials such as bedrock.

BACKGROUND OF THE INVENTION

Helical screw anchors are used extensively in construction to transfer loads from structures to the ground. The helical screw anchors must be installed parallel to the direction of pull or push from the load. Anchors are configured to auger into the ground providing a base for both compression and tension applications.

Loose to medium dense soils, fine to coarse sand and sandy gravel, as well as firm clay are the ground components that helical screw anchors are designed to auger through. Obstructions in the ground, such as a rock, can stress and shear the shaft or helix. With a conventional ground anchor, when hardpan such as bedrock or a large rock is encountered, it is necessary to pull out the anchor assembly. Assuming the anchor is not damaged, an attempt to drill to the correct depth from another point is performed.

In the event that a rock formation is quite large, moving the drilling location may not be a viable option. Another option could be predrilling a hole in the rock but in larger applications this would be costly and unfeasible.

Presently there lacks a helical screw anchors system that is effective in all underground applications. Even helical screw anchors with sharp curved leading edges are not suitable for cutting through solid rock. The edges easily become dull and therefore cannot auger through solid immovable rock.

U.S. Pat. No. 5,113,626 discloses an earth anchor apparatus having a hub with a longitudinal axis and first and second axial ends, and a load-bearing helix affixed to the hub. The load-bearing helix includes a generally radially extending leading edge adjacent to the first end of the hub, a generally radially extending trailing edge adjacent the second end of the hub, an inner circumferential section connected to the hub, and an outer circumferential section extending radially outward from the inner circumferential section and having an outer circumferential edge separated from the inner section.

U.S. Pat. No. 5,408,788 discloses a high strength cast screw having a hollow, installation wrench receiving hub, a helical, load bearing element projecting outwardly from the hub, and an elongated, pointed end spade integral with and extending away from the hub. The spade has two diametrically opposed, angularly disposed cutting margins located on opposite sides of the axis of the hub.

U.S. Pat. No. 5,213,448 discloses an anchor assembly having a support fastened to the foundation and a screw anchor installed in the earth in generally upright disposition with an upper end thereof located adjacent the foundation. The upper end is secured within a sleeve of the support assembly by a bonding composition to prevent movement of the screw anchor relative to the sleeve. During assembly of the apparatus, a lower bracket of the support assembly is attached to the foundation of the building to be stabilized, and the screw anchor is installed in the earth in a generally upright disposition with an upper end of a rod of the anchor located adjacent the lower bracket.

U.S. Pat. No. 8,079,781 discloses a support device in the form of a push pier capable of use in high load-bearing capacity applications involving significant lateral load conditions, the push pier having a lead section with a ground penetrating friction collar, and one or more extension members that are machine fabricated with an integrally formed hardened alloy steel coupling section that is adapted to mate with the push pier lead section or another similarly constructed extension shaft U.S. Pat. No. 8,033,757 discloses a method and apparatus for placing a helical pile in the soil with minimal disturbances to the soil. The helical pile has an elongated pipe with a central chamber. The pipe has a helical blade with an opening in the trailing edge of the blade where grout is extruded. The grout fills those portions of the soil which were disturbed by the blade. Advantageously, those portions of the soil which were not disturbed by the blade are not infused with grout.

U.S. Pat. No. 7,736,095 discloses a conventionally available pile for civil engineering work is constructed such that the pile has in its inside a core body with wedges that stick into soil deep in the ground and function to prevent the pile from coming out of place.

U.S. Pat. No. 7,314,335 discloses an anchor pile apparatus has a helical anchor rotatable by a power source through an intermediate drive member. The drive member extends through a plurality of hollow pile sections, which are driven, one by one, into the soil following the penetration of the anchor. In one of the embodiments, the anchor and the pile sections are rotated separately by independent motors, thus expediting the installation of the pile in the pre-determined location.

U.S. Pat. No. 7,114,886 discloses a structural helical pile having an elongate shaft member a longitudinal axis. The structural helical pile also comprises a radially extending, generally helical load bearing member integral with the shaft member and projecting outwardly from the longitudinal axis of the shaft member. The helical load bearing member has a leading edge and a trailing edge. The respective leading and trailing edges intersect the shaft member in spaced relationship along the longitudinal length of the shaft member. The helical loadbearing member further comprises at least one rib integrally formed therein. In this aspect, each rib extends outwardly from the longitudinal axis of the shaft member and has a substantially uniform cross-sectional thickness.

U.S. Pat. No. 7,112,012 discloses an in-situ pile apparatus includes a helical anchor to which a plurality of elongated generally cylindrically shaped sections can be added. Each of the sections has a specially shaped end portion for connecting to another section. An internal drive is positioned in sections inside the bore of each of the connectable pile sections. The internal drive includes enlarged sections that fit at the joint between pile sections. In one embodiment, the internal drive can be removed to leave a rod behind that defines reinforcement for an added material such as concrete U.S. Pat. No. 6,817,810 discloses a piercing device includes a shaft having interspaced threaded portions and unthreaded portions extending axially along at least a portion of its length. The unthreaded portions of the shaft are radially recessed with respect to the threaded portions. A helical plate with a threaded passageway can engage the threaded portions of the shaft at any desired location along the shaft. A key is then inserted into the passageway between the helical plate and an unthreaded portion of the shaft to hold the helical plate at the desired location on the shaft.

U.S. Pat. No. 6,871,455 discloses a reinforced ground anchor including a spike, a pressure cap having a planar surface, a rod having a drive section at one end, and a swivel connection connecting said pressure cap with the rod. An opening is formed in the pressure cap. A guide is located adjacent the opening. The pressure cap engages flush with the surface of the ground, due to the action of the swivel connection, when the rod is positioned in the ground soil and the spike passes through the opening to engage in the ground soil at an acute angle. The spike and the cap in combination with the rod provide the anchor with additional resistance against horizontal and vertical pressure.

U.S. Pat. No. 8,096,732 discloses methods and apparatus for foundation systems generally include a vertical support, a horizontal support configured to couple to the vertical support, and a composite material configured to couple to the horizontal support. The vertical support may be configured to resist fluctuation in soil elevation. The composite material may comprise a block material and a fibrous material.

U.S. Pat. No. 5,120,163 discloses an apparatus and method for stabilizing the foundation of an existing building structure which may or has experienced settlement or movement. A support for the foundation is provided that is adapted to be located at a position in underlying relationship to the foundation structure. A screw anchor having an anchor shaft and at least one helix thereon is driven into the ground adjacent the foundation support. An inverted U-shaped coupler adapted to be temporarily secured to the foundation support receives a jacking device there-within extending between the top of the coupler and the foundation support so that upon positioning of the support in supporting relationship to the foundation and insertion of the anchor into the ground.

SUMMARY OF THE INVENTION

The present invention is an improved anchor having a cutting bits strategically positioned to allow the anchor to cut through rock during installation. The improved anchors ensures that a ground anchor device will be able to auger to the proper depth necessary to support the load of the structure.

Accordingly, it is an objective of the instant invention to have a plurality of carbide coated steel cutting tips attached to the distal end of the shaft. The cutting tips extend past the distal end and make an initial cut into rock.

It is a further objective of the instant invention to attach a plurality of carbide steel tips on the leading edge of helical plates to enable additional rock cutting.

It is another objective of the invention to eliminate broken ground anchors that are sheared due to the stress placed upon the anchor shaft while attempting to drill through rock without cutting tips.

It is yet another objective of the instant invention to facilitate ground anchor placement by providing an inexpensive improvement to ground anchors for use in ground that has a likelihood of the presence of rock.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
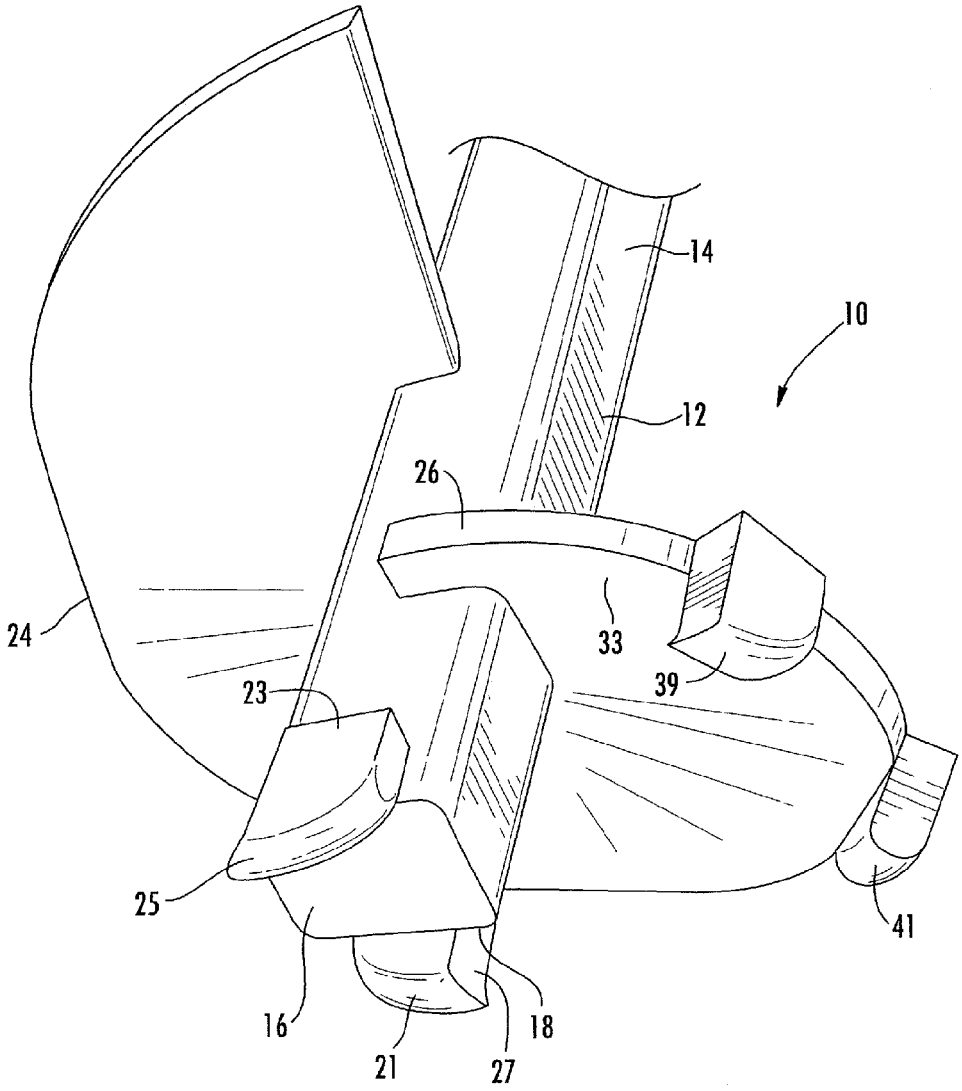
FIG. 1 is a perspective view of the present invention.
Figure 2:
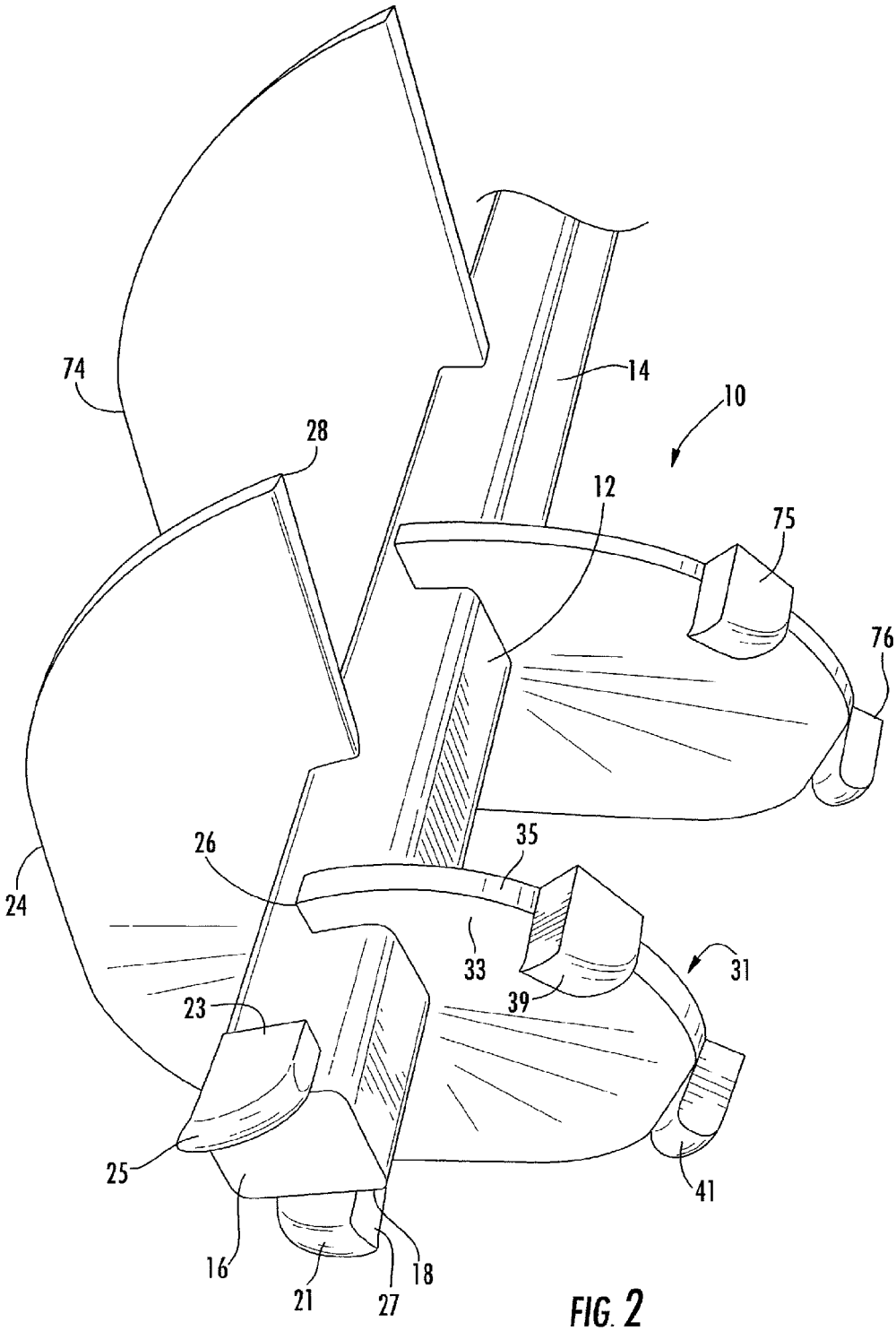
FIG. 2 is a perspective side view of the present invention with a second helix attached.
Figure 3:
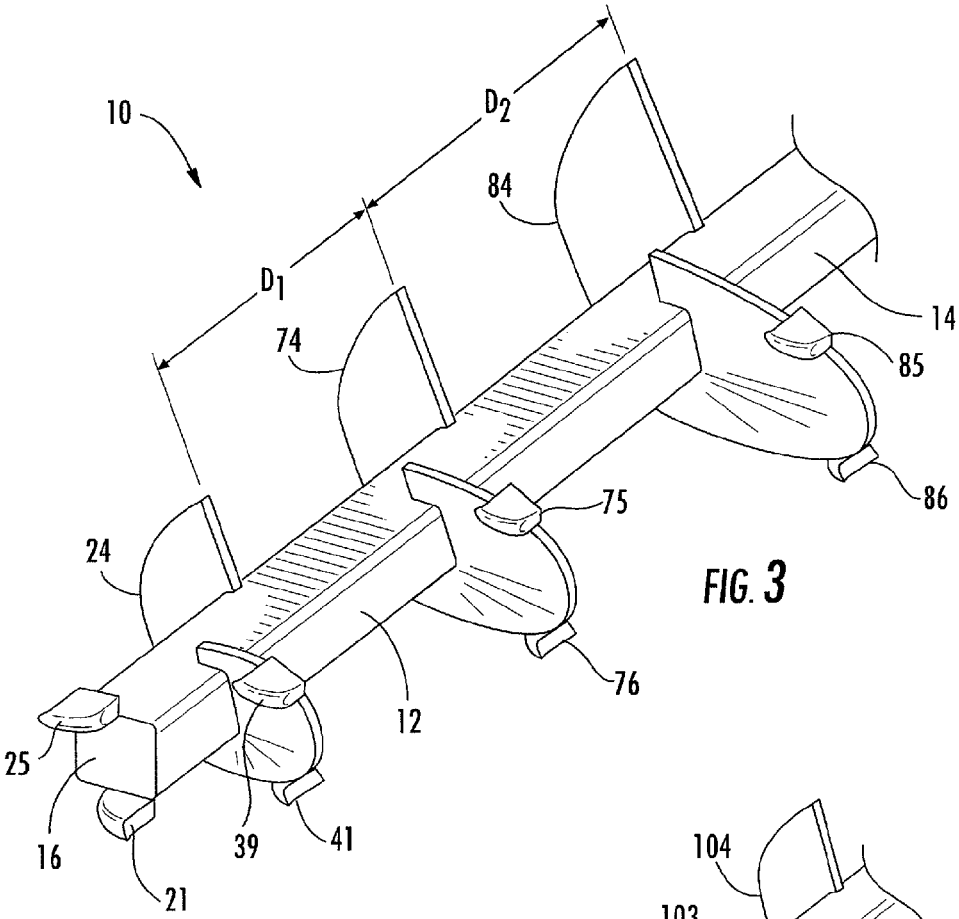
FIG. 3 is a perspective side view of the present invention with multiple helixes attached.
Figure 4:
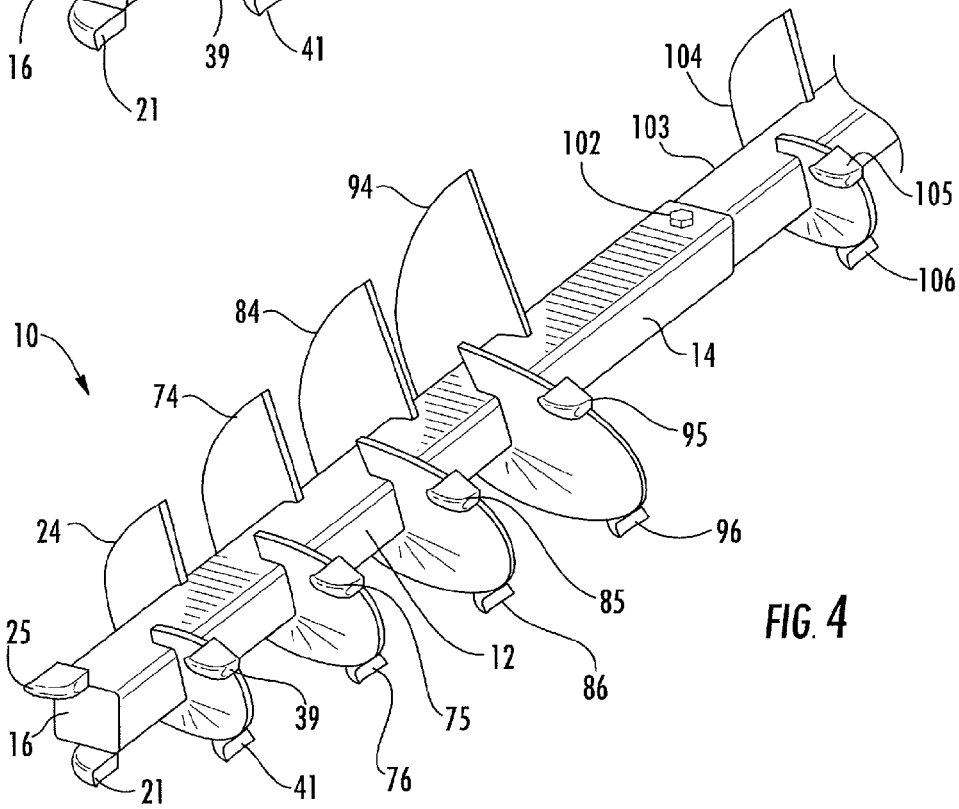
FIG. 4 is a perspective side of the present invention depicting multiple helixes attached in segments.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Now referring to the figures, which illustrate the present invention and the manner in which it is used with like components numbered consistently throughout. A ground anchor assembly with a leading section cutting device 10 is comprised of a shaft member 12 having a longitudinal axis that extends longitudinally and thereby defines an axis of rotation. The shaft includes a proximate end 14 and distal end 16. The shaft member 12 can be of a substantially rectangular or substantially cylindrical shape. The proximate end 14 is constructed and arranged for attachment of a driving mechanism. The distal end 16 includes a first notch 18 extends into the shaft member 12 constructed and arranged for attachment of a first cutting tip 21. A second notch 23 extends into the shaft member 12 on the opposite side of the first notch 18 and is constructed and arranged for attachment of a second cutting tip 25.

While placement of the cutting tips in according with the illustration, each of the cutting tips are of a similar shape and design. The cutting includes a top surface, a bottom surface, and a plurality of side surfaces. The side surfaces are constructed and arranged at an acute angle thereby forming a cutting edge. Each cutting tip comprises impregnated carbide steel of an amount sufficient to cut through the rock. In particular, a layer of tungsten carbide, titanium carbide, vanadium carbide or the like hard material/compound can be electrodeposited on the outer surface on the cutting edge thereby providing an anti-abrasion and wear-resistant surface with a reduced cost in manufacturing as only the cutting edge need be modified. As shown in FIG. 1, the cutting tips 21 and extend beyond the distal end 16 of the shaft member 12. Using cutting tip 21 for further illustration, the cutting edge is primarily on the front side surface 27 and can extend along the lower bottom surface. The cutting edge is unidirectional as further illustrated in FIG. 1 wherein the anchor is rotated in a clockwise direction.

The shaft member 12 of the ground anchor includes at least one helically shaped plate 24 that extends around the shaft member 12. The helically shaped plate 24 is fixedly attached to the shaft member 12 and extends radially outward therefrom. The helically shaped plate 24 is positioned at a predetermined distance above the distal end 16. The helically shaped plate 24 includes a leading edge 26 and a trailing edge 28. The helically shaped plate 24 has a top surface 31, a bottom surface 33 and an outer perimeter surface 35. The leading edge 26 is constructed and arranged to cooperate with at least one cutting tip 39. The cutting tip 39 is positioned to extend below the bottom surface 33 of the helically shaped plate 24 along the axis of rotation, in this example clockwise.

The cutting devices are positioned away from a leading edge 26 of the helically shaped plate 24, as depicted in the Figures. In this embodiment, a first helically shaped plate 24 has a leading edge 26 sized to be at a distance less than the diameter of the cutting tips 21 and 25. The leading edge 26 cooperates with the fixed attachment of at least two cutting tips 39 and 41, positioned to effectuate proper cutting positions to enter the stone after the primary cutting tips 21 and 25 create a borehole. The cutting tips are positioned to extend below the bottom surface 33 of the helically shaped plate 24 along axis of rotation.

Each cutting tip 21, 25, 39 and 41 includes a top surface, a bottom surface, a leading edge, and a trailing edge. The leading edge is constructed and arranged at an acute angle thereby forming a cutting edge as depicted in the Figures. The side surfaces and form a predetermined thickness sized to provide sufficient strength for rock engagement. In a similar manner as cutting tips 21 and 25, helical plate mounted cutting tips 39 and 41 each include a layer of tungsten carbide, titanium carbide, vanadium carbide or other hard material/compound electrodeposited forming an anti-abrasion and wear-resistant surface.

The shaft member 12 is constructed and arranged for attachment to the shaft of any ground anchor device. In a preferred embodiment each cutting tip is attached by weldment.

In an alternative embodiment, a second helical plate is attached at a defined distance $D_1$ from helical plate 24, having cutting tips 75 and 76 positioned to extend below the bottom surface of the helically shaped plate 74 along the axis of rotation. Additionally a third helical plate 84 is attached at a defined distance $D_2$ from helical plate 74, having cutting tips 85 and 86 positioned to extend below the bottom surface of the helically shaped plate 84 along the axis of rotation. The distance between plates is dependent upon the soil density. Soil contains mineral particles mixed with organic matter. However, soil may also contain sand, rock, limestone, clay and many other materials having different densities.

Additional helical plates may also be attached, again dependent the material type. Illustrate is plate 94 having cutting tips 95 and 96 positioned to extend below the bottom surface of the helically shaped plate 74 along the axis of rotation. Additionally, another shaft 103 is fixed attached with a suitable fastener 102. Attached to shaft 103 is a helical plate 104, having cutting tips 105 and 106 positioned to extend below the bottom surface of the helically shaped plate 104 along the axis of rotation.

The ground anchor helixes can be the same size or can be varied. In a non-limiting but preferred arrangement, a series of helix diameters can start at 8" and increase each successive helix by increments of 2". Each helix diameter includes the cutting tips allowing sequentially larger holes to be punched through rock formations. The additional shafts 103 can coupled end to end providing anchor depths of three hundred feet or more. Each shaft 103 may, but is not required, to include one or more helical shaped plates. The actual arrangement of the helical shaped plates including size and placement to an adjacent helix is dependent upon the soil constituents.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A ground anchor assembly with a leading section cutting device comprising:

a shaft member having a longitudinal axis defining an axis of rotation between a proximate end and a distal end, said proximate end temporarily securable to a driving mechanism;

a first and second borehole cutting tip securable to the distal end of said shaft member, said first borehole cutting tip securable to a first side surface of said shaft member having a first notch and said second borehole cutting tip securable to a second side surface of said shaft member having a second notch, said first borehole cutting tip and first notch constructed and arranged to direct said first borehole cutting tip to extend outwardly from the distal end, said second borehole cutting tip and said second notch forming a mirror image to said first borehole cutting tip and said first notch;

at least one helically shaped plate secured to said shaft member, said at least one helically shaped plate having a top surface and a bottom surface with an outer perimeter surface, said at least one helically shaped plate having a leading edge positioned approximate to said distal end and a trailing edge spaced apart from said distal end by a predetermined distance;

a first plate cutting tip attached to the leading edge of said at least one helically shaped plate, said first plate cutting tip positioned to extend below the bottom surface of said at least one helically shaped plate and parallel to the axis of rotation;

a second plate cutting tip attached to the perimeter edge of said at least one helically shaped plate, said second plate cutting tip positioned to extend below the bottom surface of said at least one helically shaped plate and parallel to the axis of rotation;

wherein rotation of said shaft permits the first and second borehole cutting tips to bore through rock and said first and second plate cutting tips available to enter the rock after the first and second borehole cutting tips to bore through rock whereby said at least one helically shaped plate ensures that a ground anchor device will be able to auger to a proper depth necessary to support a load of a structure.

2. The ground anchor assembly according to claim 1, wherein said ground anchor assembly includes additional helically shaped plates, each additional helically shaped plate positioned at a predetermined distance along said shaft with a first helically shaped plate positioned closest to the distal end.

3. The ground anchor assembly according to claim 1, wherein said first helically shaped plate includes an arcuate leading edge constructed and arranged to cooperate with fixed attachment of said plate cutting tips.

4. The ground anchor assembly according to claim 2, wherein said additional helically shaped plates include an arcuate leading edge constructed and arranged to cooperate with fixed attachment of at least one cutting tip.

5. The ground anchor assembly according to claim 1 wherein each said cutting tip is constructed from carbide steel.

6. The ground anchor assembly according to claim 1 wherein said shaft member is substantially rectangular.

7. The ground anchor assembly according to claim 1 wherein said shaft member is substantially cylindrical.

8. The ground anchor assembly according to claim 1 wherein each said cutting tip is attached by weldment.

9. The ground anchor assembly according to claim 2 wherein each said additional helically shaped plate includes a diameter greater than the helically shaped plate positioned adjacent the distal end.

10. The ground anchor assembly according to claim 1 wherein said shaft member is rectangular shaped.

11. The ground anchor assembly according to claim 10 wherein said rectangular shaped shaft member is securable to an additional rectangular shaped shaft member.

12. The ground anchor assembly according to claim 11 wherein said additional shaft member includes at least one helical shaped plate.

13. The ground anchor assembly according to claim 12 wherein each helical shaped plate includes at least one carbide steel cutting tip.

14. The ground anchor assembly according to claim 1 wherein said shaft member is cylindrically shaped.

15. The ground anchor assembly according to claim 14 wherein said cylindrically shaped shaft member is securable to an additional cylindrically shaped shaft member.

16. The ground anchor assembly according to claim 15 wherein said additional cylindrically shaft member includes at least one helical shaped plate.

17. The ground anchor assembly according to claim 16 wherein each helical shaped plate includes at least one carbide steel cutting tip.

* * * * *